US006237679B1

(12) United States Patent
Vestergren

(10) Patent No.: US 6,237,679 B1
(45) **Date of Patent: *May 29, 2001**

(54) PLATE HEAT EXCHANGERS

(75) Inventor: Ulf Vestergren, Tyresö (SE)

(73) Assignee: SWEP International AB, Reheat Divison, Stockholm (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/215,197

(22) Filed: Dec. 18, 1998

(30) Foreign Application Priority Data

Dec. 19, 1997 (SE) ..... 9704762

(51) Int. Cl.[7] ..... F28D 9/00
(52) U.S. Cl. ..... 165/167; 165/146
(58) Field of Search ..... 165/146, 166, 165/167

(56) References Cited

U.S. PATENT DOCUMENTS 785,580 * 3/1905 Shiels et al. .
3,498,372 * 3/1970 Patten et al. ..... 165/166
3,661,203 * 5/1972 Mesher ..... 165/167
4,470,453 * 9/1984 Laughlin et al. ..... 165/166
4,911,235 * 3/1990 Andersson et al. ..... 165/167

FOREIGN PATENT DOCUMENTS

16535 * 9/1912 (FR) ..... 165/177
1071116 * 6/1967 (GB) .
1 486 919 * 9/1977 (GB) .
320 678 * 2/1970 (SE) .
444 719 * 4/1986 (SE) .
458 718 * 4/1989 (SE) .

* cited by examiner

*Primary Examiner*—Allen Flanigan
(74) *Attorney, Agent, or Firm*—Pillsbury Winthrop LLP

(57) ABSTRACT

Plate heat exchanger in the form of heat exchanger plates having several corrugated heated surfaces (4) arranged next to one another and tightly sealed with one another, and with two flow paths (10, 11) separated from one another where one of the flow paths (10) has a larger cross-sectional flow through than the other flow path (11), whereby the heat exchanger consists of a number of identically formed plates with an asymmetric cross-sectional shape seen in relation to the central plane (5) of the plate, the lower surface of the grooves of the gasket are located in the central plane of each respective plate, the same sides of every other plate (8) are turned to face the same direction in the heat exchanger, and the equivalent sides of the other plates (9) are turned to face the opposite direction.

8 Claims, 2 Drawing Sheets

PLATE HEAT EXCHANGERS

FIELD OF THE INVENTION

The present invention refers to a plate heat exchanger.

BACKGROUND OF THE INVENTION

Plate heat exchangers are well known and are generally used to transfer heat from one flowing medium to another. Because of their compound construction and usefulness for different tasks, plate heat exchangers are easy to optimize for their intended function and level of efficiency. Plates in the same plate heat exchanger normally have the same design and usually both of the liquid flow paths have the same cross-sectional area of flow through. In situations where media with different viscosities, e.g. water and oil, or when one medium is gaseous in form, e.g. water and steam, are to exchange heat it is necessary that the more viscous of the media, e.g. oil, has as little resistance to flow as possible, or that the gaseous medium, e.g. steam, is provided with a sufficient volume of through flow. For these reasons, it is desirable to increase the cross-section of flow through in one of the flow paths, in this case, the one intended for oil or steam. This enlargement of the cross-section of flow through between every other heat exchanger plate in the plate heat exchanger can be achieved by designing every other plate with spacing devices that form bulges. The spacing devices can be pressed into the plate, but can also be formed by lugs, loops or similar being attached by welding to every other plate, or by the attachment of mouldings between the plates. By instead producing two different types of plate patterns, it is also possible to achieve flow paths with different cross-sections of flow through. Irrespective of the method of achieving the objective, this nevertheless leads to an increase in the cost of the plate heat exchanger, at the same time as the presence of the spacer devices can in some cases have an adverse effect on the liquid flow.

SUMMARY OF THE INVENTION

With the help of the invention, a plate heat exchanger is achieved with alternating broad and narrow channels that, due to the use of identical plates, is simpler and therefore less expensive to manufacture and assemble.

BRIEF DESCRIPTION OF THE DRAWINGS

The invention will be described in the form of examples with reference to drawings, as follows.

DETAILED DESCRIPTION OF THE INVENTION

Figure 1:
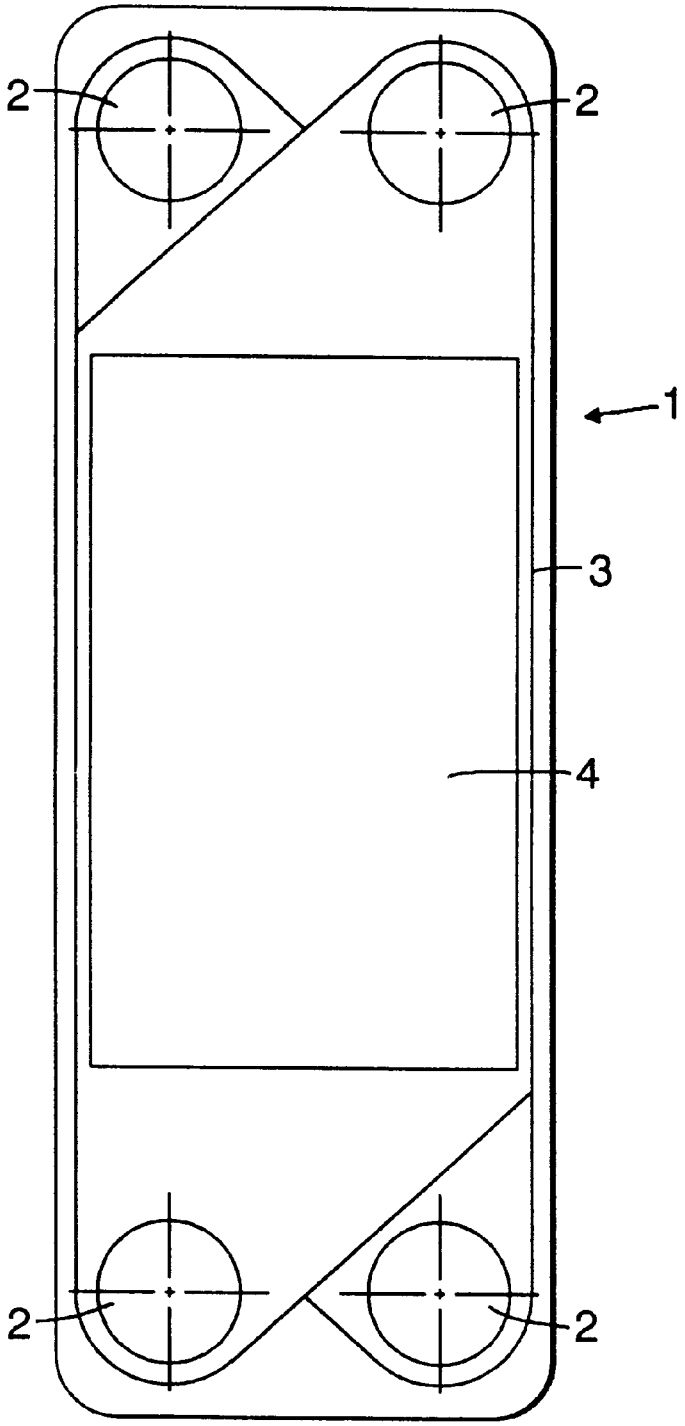
FIG. 1 shows schematically a plate heat exchanger.

The plate heat exchanger 1 shown schematically in FIG. 1 includes the commonly encountered inlet and outlet ports 2, a groove 3 for a gasket extending around the plate and the ports, and a heated surface 4. The heated surface 4 normally comprises a section with corrugation arranged in a herringbone pattern, whereby the heated surface can be divided into several sections or areas with different herringbone shapes.

It should be understood that even the plate described above is of the type that is commonly encountered.

According to the invention, the heated surface 4 of the plate has been given a shape that is asymmetric in relation to the central plane 5 of the plate (see FIG. 2) in that every other "peak" in what can be considered to be essentially a sinusoidal profile 6 has been "cut off", whereby the heated surface 4 has flattened sections at these points. The gasket groove 3 of the plate has its lower surface located in the central plane 5 (not shown in the figures).

Figure 2:
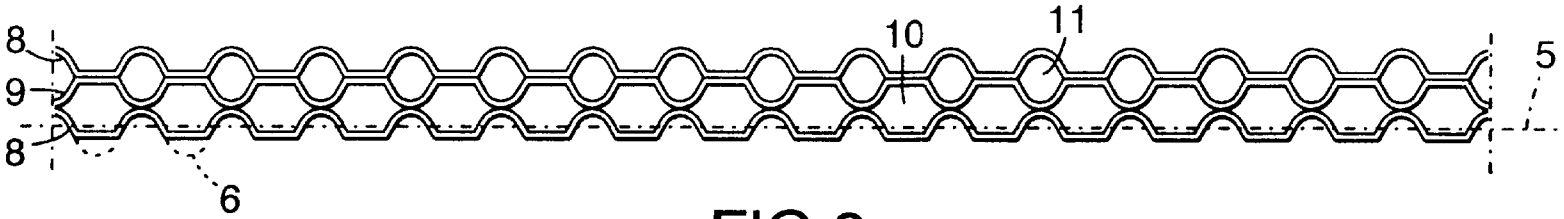
FIG. 2 is a partial sectional view through three heat exchanger plates mounted next to one another.
Figure 4:
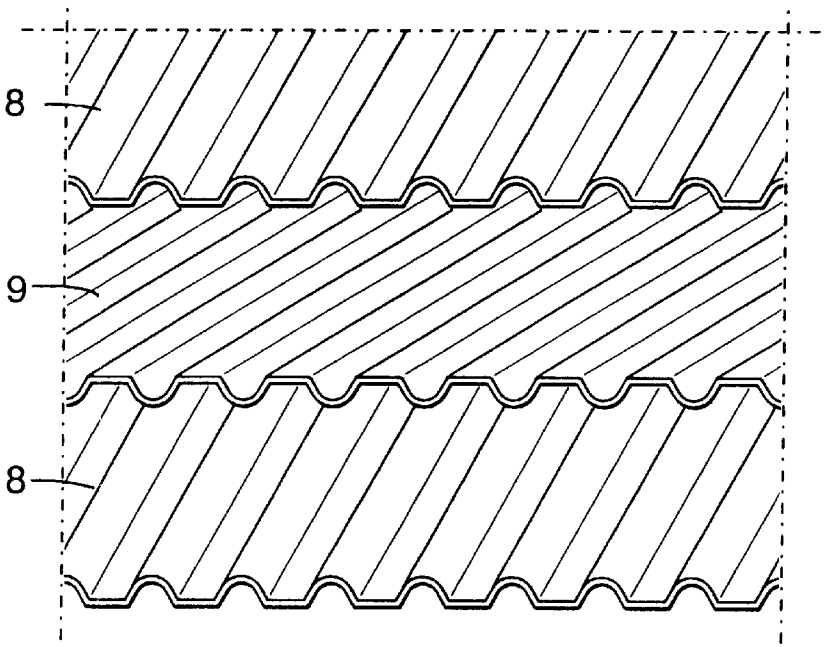
FIG. 4 is another partial sectional view of the orientation of the corrugated heated surface.
Figure 3:
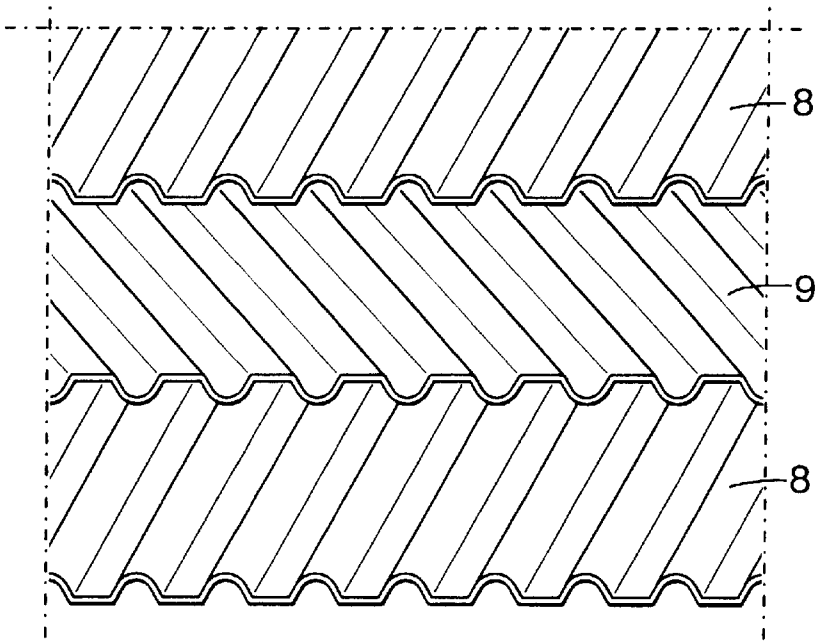
FIG. 3 shows a partial sectional view of one example of the mutual orientation of the heated surfaces of the three plates in the plate heat exchanger according to FIG. 2.

According to the invention, the plate heat exchanger consists of a number of identically shaped plates 1 with an asymmetric form, such as shown in FIG. 2–4. By arranging the plates in the plate heat exchanger so that every other plate, for example adjacent corrugated heat exchanger plates 8, 8, has the same side turned to face the same direction and the other plates 9 (only one is shown) are turned i.e., inverted, with the equivalent sides to face the opposite direction, the plate heat exchanger is provided with alternating broad and narrow channels, 10 and 11 respectively. As shown in FIG. 2, the corrugated heat exchanger plate 9 has (first) peak surface portions on a lower (or first) surface thereof that contact first peak surface portions of an equivalent first surface of the lower adjacent corrugated heat exchanger plate 8 to define the broad changes 10. Likewise, the corrugated heat exchanger plate 9 has (second) flat peak surface portions on an upper (or second) surface thereof that contact second flat peak surface portions of an equivalent second surface of the upper adjacent corrugated head exchanger plate 8 to define the narrow channels 11.

FIG. 3 and 4 show schematically two examples of how the heated surfaces of the plates and their herringbone angles can interact.

It should be understood that the identical plates with their heated areas included in the plate heat exchanger according to the invention can have a different corrugated profile than that shown in FIGS. 2–4. The profile shape that is selected is that considered by a person skilled in the art to give the best effect with regard to the prevalent circumstances, which is why there is no reason to go into greater detail regarding the design of the heated surfaces. In this context, it can be pointed out that it is naturally possible, as mentioned previously, to divide up the heated surface with differently shaped profiles in the same plate and thereby permit a further optimization of the level of efficiency.

What is claimed is:

1. A plate heat exchanger comprising a plurality of identical corrugated heat exchanger plates, each of said identical corrugated heat exchanger plates of said plurality having a respective central plane and being asymmetrical in cross section relative to said respective central plane, wherein said corrugated heat exchanger plates are arranged next to each other in a tightly sealed arrangement and alternating corrugated heat exchanger plates are inverted so that at least one of said corrugated heat exchanger plates has (a) a first corrugated heated surface contacting a first corrugated heated surface of a first adjacent one of said corrugated heat exchanger plates to define smaller cross-sectional area flow paths therebetween and (b) a second corrugated heated surface contacting a corrugated heated surface of a second adjacent one of said corrugated heat exchanger plates to define larger cross-sectional area flow paths therebetween, said larger cross-sectional area flow paths being separated from said smaller cross-sectional flow paths.

2. The plate heat exchanger of claim 1, wherein said corrugated heat exchanger plates have cross sections defining substantially sinusoidal patterns, with the sinusoidal patterns being interrupted by alternating flat peaks of said corrugated heat exchanger plates.

3. The plate heat exchanger of claim 1, wherein each of said corrugated heat exchanger plates has a respective groove formed therearound for receiving a gasket, said respective groove having a bottom located in said respective central plane.

4. A plate heat exchanger comprising a plurality of identical corrugated heat exchanger plates, each of said identical corrugated heat exchanger plates of said plurality having a respective central plane, a respective first corrugated heated surface with first peak surface portions, and a respective second corrugated heated surface with second peak surface portions, wherein each of said corrugated heat exchanger plates is asymmetrical in cross section relative to said respective central plane, and wherein said corrugated heat exchanger plates are arranged next to each other in a tightly sealed arrangement and alternating corrugated heat exchanger plates are inverted so that, in cross section, at least one of said corrugated heat exchanger plates has (a) said first peak surface portions thereof contacting first peak surface portions of an adjacent one of said corrugated heat exchanger plates to define smaller cross-sectional area flow paths and (b) said second peak surface portions thereof contacting second peak surface portions of another adjacent one of said corrugated heat exchanger plates to define larger cross-sectional area flow paths, said larger cross-sectional area flow paths being separated from said smaller cross-sectional flow paths.

5. The plate heat exchanger of claim 4, wherein each of said corrugated heat exchanger plates has a respective groove formed therearound for receiving a gasket, said respective groove having a bottom located in said respective central plane.

6. A plate heat exchanger comprising a plurality of identical corrugated heat exchanger plates, each of said identical corrugated heat exchanger plates of said plurality having a respective central plane, a respective first corrugated heated surface with first peak surface portions, and a respective second corrugated heated surface with flat second peak surface portions, wherein each of said corrugated heat exchanger plates is asymmetrical in cross section relative to said respective central plane, and wherein said corrugated heat exchanger plates are arranged next to each other in a tightly sealed arrangement and alternating corrugated heat exchanger plates are inverted so that, in cross section, at least one of said corrugated heat exchanger plates has (a) said first peak surface portions thereof contacting first peak surface portions of an adjacent one of said corrugated heat exchanger plates to define smaller cross-sectional area flow paths and (b) said flat second peak surface portions thereof contacting flat second surface portions of another adjacent one of said corrugated heat exchanger plates to define larger cross-sectional area flow paths, said larger cross-sectional area flow paths being separated from said smaller cross-sectional flow paths.

7. The plate heat exchanger of claim 6, wherein said corrugated heat exchanger plates have cross sections defining substantially sinusoidal patterns, with the sinusoidal patterns being interrupted by said flat second peak surface portions.

8. The plate heat exchanger of claim 6, wherein each of said corrugated heat exchanger plates has a respective groove formed therearound for receiving a gasket, said respective groove having a bottom located in said respective central plane.

* * * * *